US010633214B2

(12) United States Patent
Qian

(10) Patent No.: US 10,633,214 B2
(45) Date of Patent: Apr. 28, 2020

(54) SPOOL

(71) Applicant: Suzhou Tianyu Plastic Co., Ltd., Suzhou, Jiangsu (CN)

(72) Inventor: Xiaoren Qian, Jiangsu (CN)

(73) Assignee: Suzhou Tianyu Plastic Co., Ltd., Suzhou (CN)

( * ) Notice: Subject to any disclaimer, the term of this patent is extended or adjusted under 35 U.S.C. 154(b) by 0 days.

(21) Appl. No.: 16/312,364

(22) PCT Filed: Feb. 24, 2017

(86) PCT No.: PCT/CN2017/074811
§ 371 (c)(1),
(2) Date: Dec. 21, 2018

(87) PCT Pub. No.: WO2018/152782
PCT Pub. Date: Aug. 30, 2018

(65) Prior Publication Data
US 2019/0233250 A1 Aug. 1, 2019

(51) Int. Cl.
*B65H 75/28* (2006.01)
*B65H 75/32* (2006.01)

(52) U.S. Cl.
CPC ..... *B65H 75/28* (2013.01); *B65H 75/32* (2013.01); *B65H 2701/53* (2013.01)

(58) Field of Classification Search
CPC ..... B65H 75/28; B65H 75/32; B65H 2701/53
See application file for complete search history.

(56) References Cited

U.S. PATENT DOCUMENTS

| | | | | |
|---|---|---|---|---|
| 9,098,241 | B1 * | 8/2015 | Cho | H05K 1/028 |
| 2005/0258299 | A1 * | 11/2005 | Burchett | B21C 47/323 242/532 |
| 2009/0054219 | A1 * | 2/2009 | Wu | B65H 75/28 492/22 |
| 2016/0107858 | A1 * | 4/2016 | Cheng | B65H 18/28 242/160.4 |
| 2018/0099835 | A1 * | 4/2018 | Couchey | B65H 75/10 |

FOREIGN PATENT DOCUMENTS

| | | |
|---|---|---|
| CN | 201961903 U | 9/2011 |
| CN | 105800394 A | 7/2016 |
| CN | 205527080 U | 8/2016 |

OTHER PUBLICATIONS

International Search Report of PCT Patent Application No. PCT/CN2017/074811 dated Nov. 22, 2017.

* cited by examiner

*Primary Examiner* — Sang K Kim

(57) ABSTRACT

A spool includes a tube for winding a material. The outer surface of the tube is provided with a step portion along the axial direction thereof. The step portion is as high as the thickness of the material. A cutting groove is provided on a side, close to the axial centre of the tube, of the step portion. A resilient clip for clamping the material is fixed in the cutting groove, the upper end of the resilient clip is connected to a notch on one side of the cutting groove, and the lower end thereof is inclined towards the other side of the cutting groove. The spool positions a cutter by means of the cutting groove, and the resilient clip clamps the cut material in the cutting groove.

8 Claims, 6 Drawing Sheets

SPOOL

TECHNICAL FIELD

The utility model relates to a winding tool, and particularly relates to a spool.

BACKGROUND ART

A spool is a component used to collect various films, tapes or papers and other soft and long material. In the process of winding the material by the spool, a few initial laps of the material are often dented by the end of the material, resulting in creases on the material. In the fields of optical films and the like which have high requirements for surface material, the material is often discarded.

To overcome the above problems, a spool is disclosed by the applicant in a Chinese utility model patent with a filing date of Mar. 21, 2011 and an application number of CN201120074757.7. The spool includes a tube used to wind material to be wound. A groove is formed in an outer surface of the tube. The groove has a vertical surface, and a bottom surface of the groove is in smooth connection with the outer surface of the tube.

In the above structure, the groove is formed so that no crease is generated in a few initial wound laps of the material to be wound. However, in practical use, due to the unevenness of the end part of the material, the end part of the material cannot be smoothly intertwined with the groove. Thus, there are still defects of dents caused by a gap between the end part and the groove in the winding process, which need to be improved.

SUMMARY OF THE INVENTION

The purpose of the utility model is to provide a spool which has the advantage of reducing the possibility of creases in the process of winding material.

The above technical purpose of the utility model is achieved through the following technical solution: a spool includes a tube used to wind the material, wherein a step portion is disposed on an outer surface of the tube along an axial direction and the height of the step portion is equal to the thickness of a single layer of material. A cutting groove is disposed at one side of the step portion close to an axis of the tube.

Through adoption of the above technical solution, when the spool winds the material, the cutting groove is convenient for positioning of a cutter so that the cutter conveniently and accurately cuts the material to ensure that the end of the material is aligned with the step portion, thereby effectively avoiding generating creases and dents in the material in subsequent winding processes due to gaps between the material and the step portion and obviously enhancing the flatness of material winding.

The utility model is further configured as follows: a resilient clip used to clamp the material is fixed into the cutting groove; an upper end of the resilient clip is connected with a notch at one side of the cutting groove; and a lower end of the resilient clip is inclined towards the other side of the cutting groove.

Through adoption of the above technical solution, when the material is cut by the cutter, the material is brought into the cutting groove and is clamped with the resilient clip, so that the material is fixed into the cutting groove. The material is ensured to align with the step portion, and a pre-fixing effect can also be played on the material.

The utility model is further configured as follows: an upper end of the resilient clip is fixed to one side of the cutting groove away from the step portion; an extension is disposed on the upper end of the resilient clip towards the tube; and the extension is embedded on the tube so that an outer surface of the extension is in smooth transition with the outer surface of the tube.

Through adoption of the above technical solution, the strength of the notch of the cutting groove is enhanced through the extension, to play a role of protecting the core-winding rube. In addition, the volume of the resilient clip is increased through the extension, thereby facilitating fixation of the resilient clip.

The utility model is further configured as follows: the extension and the resilient clip are connected through a sharp angle.

Through adoption of the above technical solution, the sharp angle between the extension and the resilient clip is used as a cut matched with the cutter, so as to enhance a cutting effect of the cutter.

The utility model is further configured as follows: a tenon is disposed at one surface of the extension towards the tube; a groove matched with the tenon is formed in the surface of the tube; and the tenon is closely matched with the groove.

Through adoption of the above technical solution, the resilient clip and the extension are fixed through insertion and connection modes, to facilitate disassembly, adjustment and replacement.

The utility model is further configured as follows: skid-proof stripes are disposed at an outer side of the resilient clip.

Through adoption of the above technical solution, the skid-proof stripes on the resilient clip come into contact with the material to increase a frictional force between the skid-proof stripes and the material, thereby enhancing a pre-fixing force of the resilient clip to the material.

The utility model is further configured as follows: the skid-proof stripes are also disposed on the step portion.

Through adoption of the above technical solution, similarly, the material is extruded by the resilient clip to come into contact with the step portion; the skid-proof stripes on the step portion and on the resilient clip play a role of double reinforcement on the material, thereby ensuring that the material is stably fixed into the cutting groove and facilitating the winding of subsequent material.

The utility model is further configured as follows: the cutting groove has a width of 1-1.5 mm and a depth of 2 mm.

Through adoption of the above technical solution, a proper size of the cutting groove is taken to ensure that the cutting groove realizes the cutting on the material.

The utility model is further configured as follows: the resilient clip has a thickness of 0.3-0.6 mm.

Through adoption of the above technical solution, a proper thickness of the resilient clip is taken so that the resilient clip is resilient and meets a clamping requirement for the material.

The utility model is further configured as follows: the extension has a thickness of 0.8-1.2 mm.

Through adoption of the above technical solution, the extension is used as a substrate of the resilient clip through the thickness which is larger than the thickness of the resilient clip, so that achieving a more firm installation and fixation of the resilient clip.

Compared with the prior art, the spool provided by the utility model has the following advantages:

1. The cutting groove is added to locate the cutter on the spool, thereby ensuring that the material cut by the cutter collides with the step portion and avoiding generating creases and dents in the material in the winding process of the material.

2. The resilient clip is arranged so that the cut material is firmly clamped in the cutting groove, thereby ensuring splicing of the material and the step portion, playing a good pre-fixing effect and reducing the creases and the dents in the material.

In the figures: 1. tube; 2. step portion; 3. cutting groove; 4. roll material; 5. resilient clip; 6. extension; 7. tenon; 8. mortise; and 9. Skid-proof stripe.

DETAILED DESCRIPTION OF THE INVENTION

The utility model will be further described below in detail with reference to the drawings.

Figure 2:
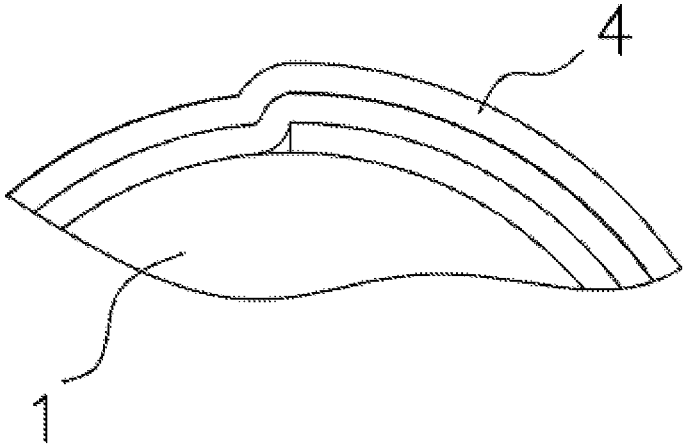
FIG. 2 is a schematic operation of a prior spool.

Embodiment 1: a spool is shown in FIG. 2, wherein the spool has a cylindrically continuous surface, when a material 4 such as a film is wound thereon, the terminal of the material 4 will dent some subsequent rolls of material 4 terminal.

Figure 3:
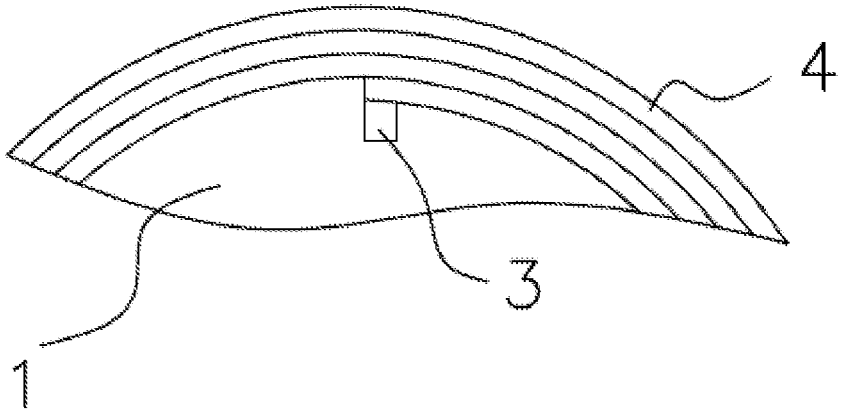
FIG. 3 shows schematically shows an operation of a spool of embodiment 1.

With reference to FIG. 3 of the description, a step portion 2 is disposed on the surface of the spool so that the diameter of the upper side of the step portion 2 is larger than the diameter of the lower side of the step portion 2. The height of the step portion 2 is set to the thickness of a film of the wound material 4. Thus, when the material 4 is paved on the lower side of the step portion 2, the outer surface of the material 4 is flush with the upper side of the step portion 2, so as to effectively eliminate such a conventional defect of dents and wrinkles.

Figure 1:
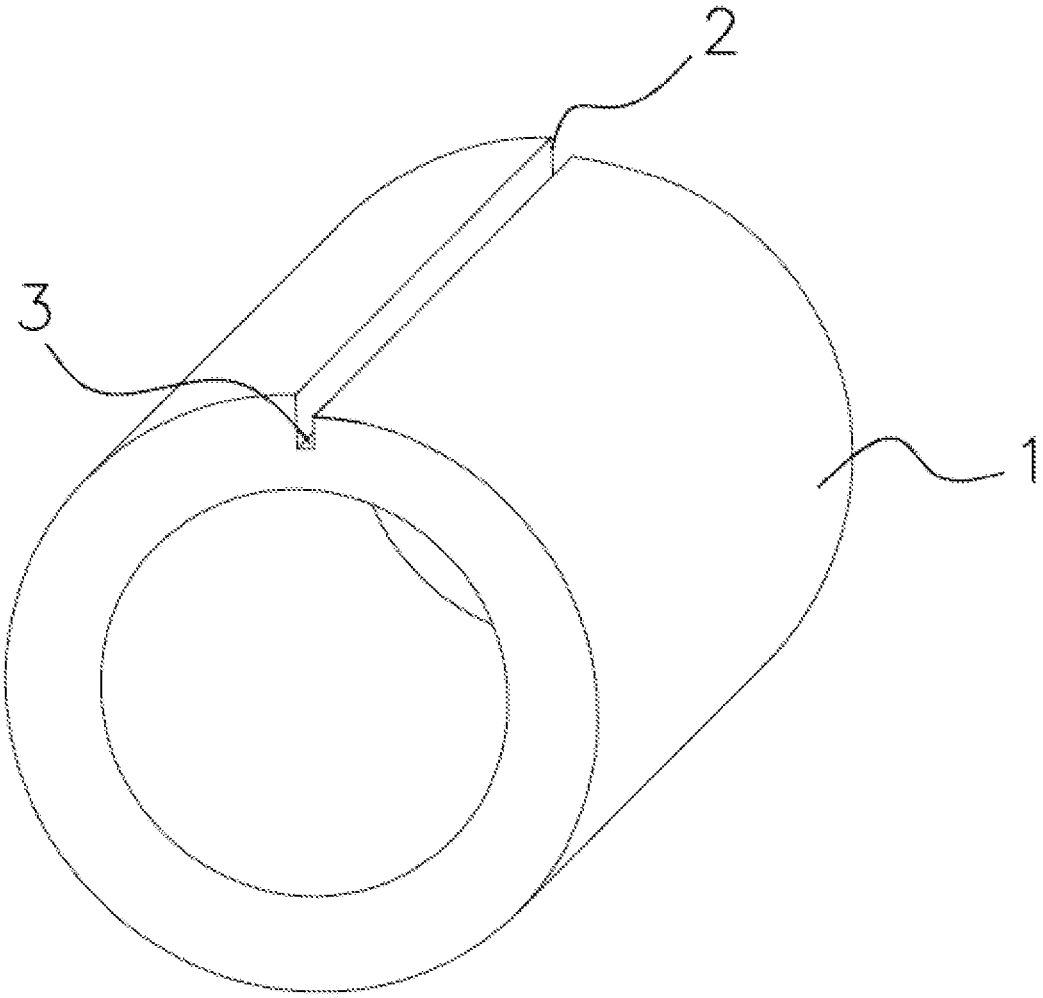
FIG. 1 is a schematic structure of a spool in embodiment 1.

With reference to FIG. 1 of the description, the step portion 2 is disposed on the surface of the spool along the axial direction of the spool. The lower side of the step portion 2 comes downwards to form a cutting groove 3, and the width of the cutting groove 3 is enough for the cutter to pass through. Once the material 4 is wound, the terminal of the material 4 is covered on the step portion 2 and is then cut through the matching of the cutter and the cutting groove 3, so as to ensure that the terminal of the material 4 is smoothly spliced with the step portion 2 after the terminal is cut, avoiding a gap between the terminal and the step portion 2.

Figure 4:
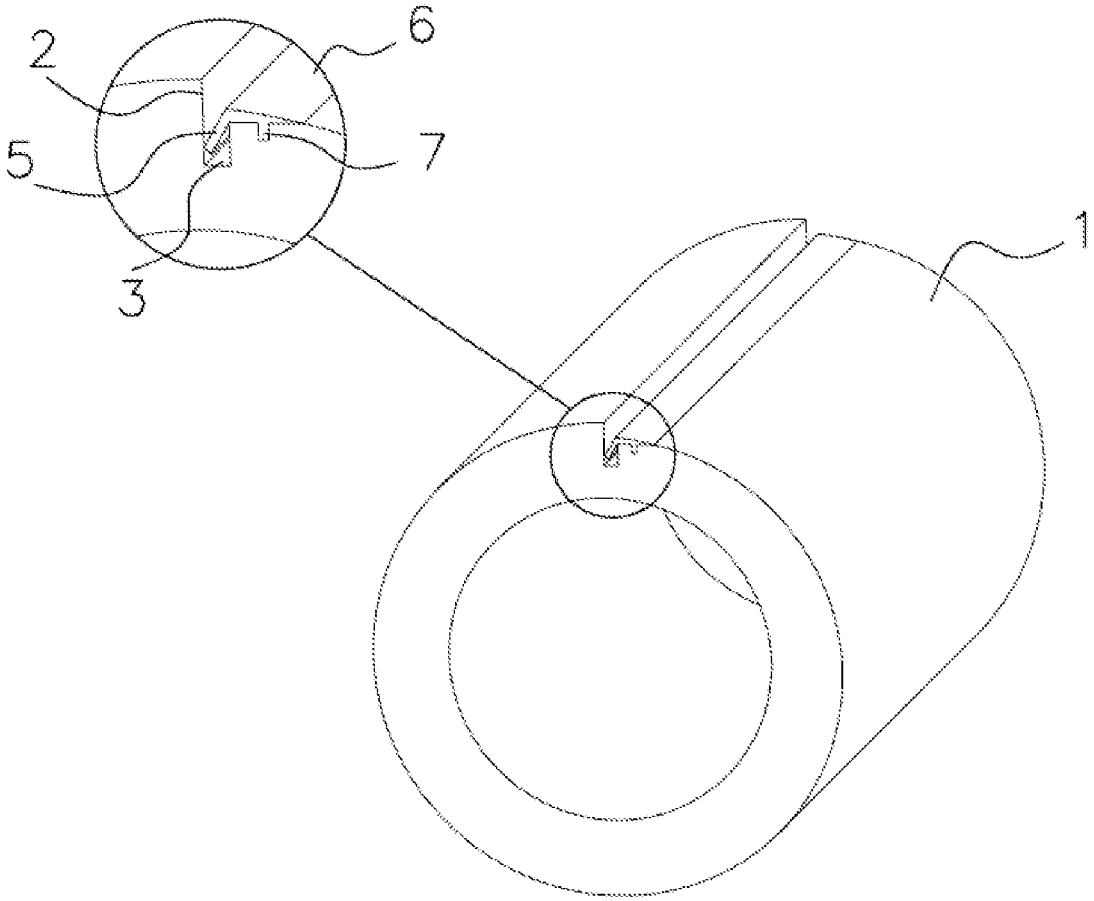
FIG. 4 is a schematic structure of a spool in embodiment 2.
Figure 5:
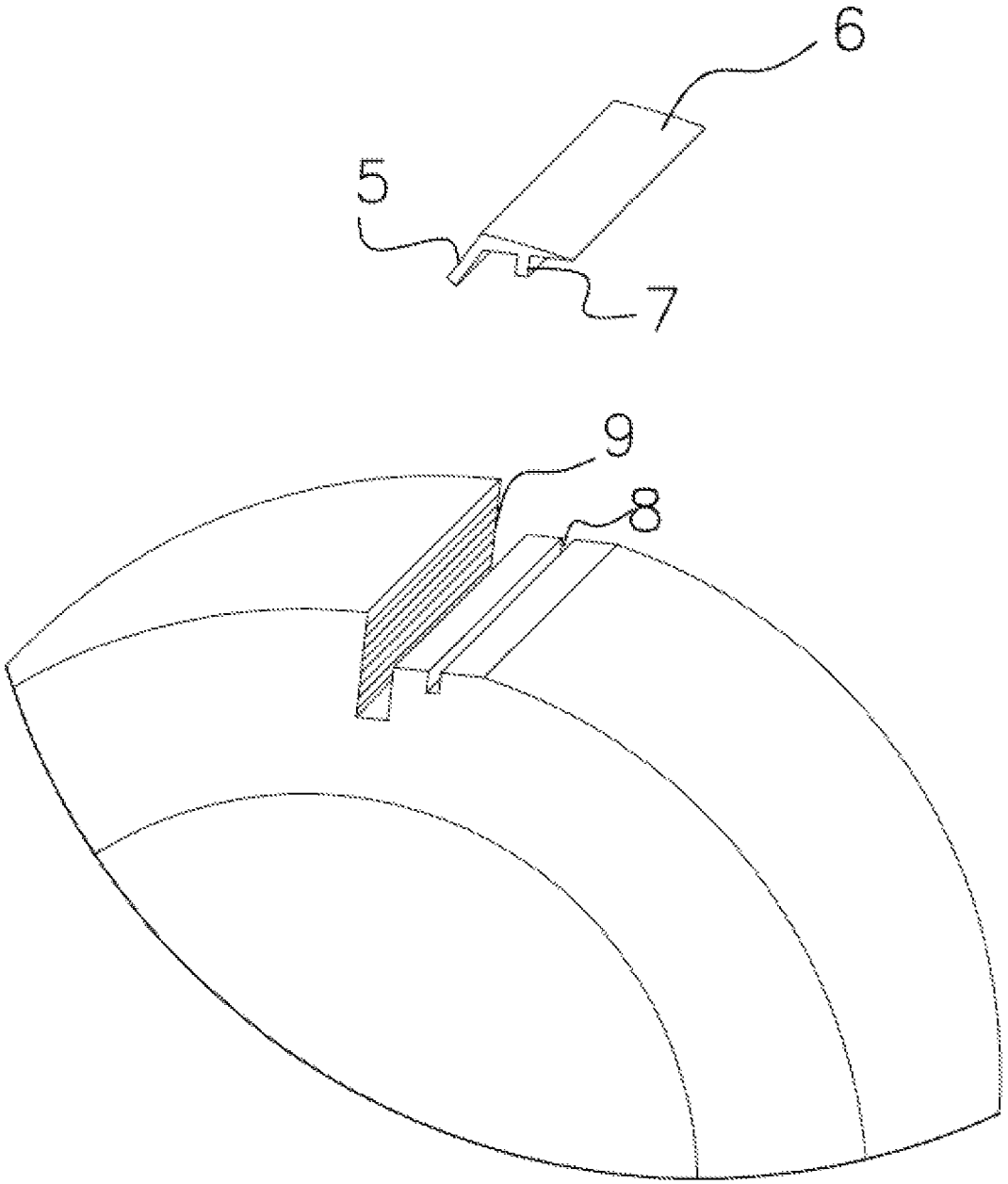
FIG. 5 is a schematically exploded view of a spool of embodiment 2.

Embodiment 2: a spool is shown in FIG. 4 and FIG. 5 of the description, the spool includes a tube 1, a step portion 2 and a cutting groove 3. The cutting groove 3 has a width of 1-1.5 mm and a depth of 2 mm. A resilient clip 5 is disposed in the cutting groove 3. An extension 6 is integrally with and above the resilient clip 5. The resilient clip 5 has a thickness of 0.3-0.6 mm. The extension has a thickness of 0.8-1.2 mm. The thickness of the resilient clip 5 is less than the thickness of the extension 6. The strength of the extension 6 is larger than that of the resilient clip 5. The extension 6 is stably fixed to the tube 1 while the resilient clip 5 can be deformed. The resilient clip 5 and the extension 6 are generally formed into the shape of the figure "7". The extension 6 is attached to the surface of the tube 1. The extension 6 has a tenon 7 inserted into a mortise 8 formed in the tube 1. The tenon 7 and the mortise 8 are engaged tightly. The extension 6 is fixed to the surface of the tube 1 by means of a static frictional force. The resilient clip 5 and the extension 6 are connected through a sharp corner so that the sharp corner can match the cutter, so that the material can be cut easily.

Figure 6:
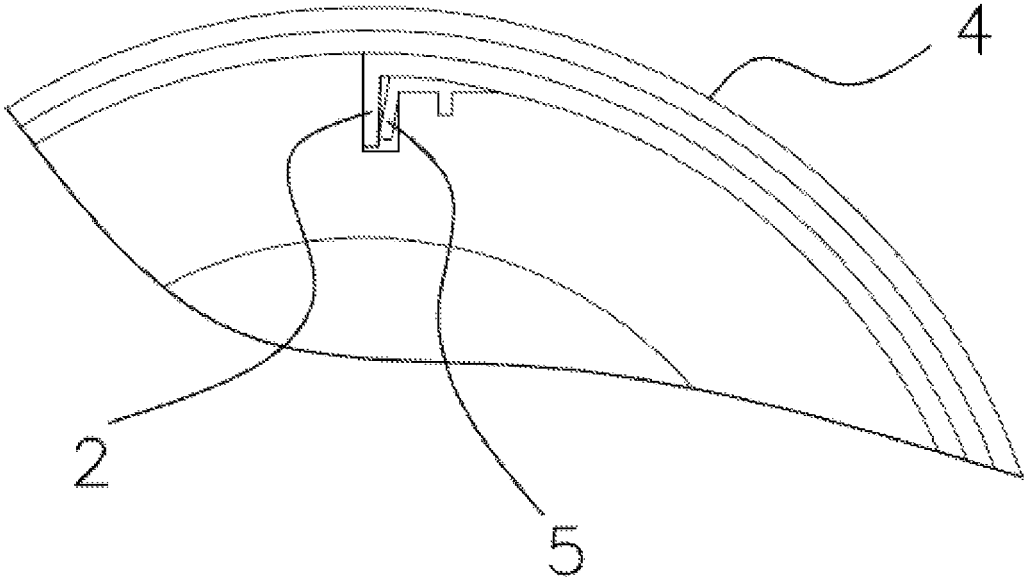
FIG. 6 schematically shows an operation of a spool of embodiment 2.

The resilient clip 5 is arranged in the cutting groove 3. The lower end of the resilient clip 5 is inclined to the step portion 2. With reference to FIG. 6 of the description, after the material 4 is cut by the cutter and brought into the cutting groove 3, a buckle is formed by the resilient clip 5 and the step portion 2 to clamp the terminal of the material 4 tightly. Meanwhile, by means of the wedging of the resilient clip 5, the resilient clip 5 effectively grips the material 4, thereby preventing the material 4 from coming out of the cutting groove 3. Skid-proof stripes 9 are disposed at opposite sides of the resilient clip 5 and the step portion 2 to enhance the clamping the material 4 between the resilient clip 5 and the step portion 2.

The specific embodiments are only used to illustrate but not to limit the utility model. Modifications without inventive contribution can be made as required to the embodiments by those skilled in the art after reading the description, and shall be protected by the patent law as long as within the scope of claims of the utility model.

What is claimed is:

1. A spool, comprising a tube (1) used to wind a material (4), wherein a step portion (2) is disposed on an outer surface of the tube (1) along an axial direction and the height of the step portion (2) is equal to a thickness of a single layer of the material (4), wherein a cutting groove (3) is disposed at one side of the step portion (2) close to an axis of the tube (1);

wherein an resilient clip (5) used to clamp the material (4) is fixed into the cutting groove (3); an upper end of the resilient clip (5) is connected with a notch at one side of the cutting groove (3); and a lower end of the resilient clip (5) is inclined towards the other side of the cutting groove (3);

wherein an upper end of the resilient clip (5) is fixed to one side of the cutting groove (3) away from the step portion (2); an extension (6) is disposed on the upper end of the resilient clip (5) towards the tube (1); and the extension (6) is embedded on the tube (1) so that an outer surface of the extension (6) is in smooth transition with the outer surface of the tube (1).

2. The spool according to claim 1, wherein the extension (6) and the resilient clip (5) are connected through a sharp angle.

3. The spool according to claim 2, wherein a tenon (7) is disposed at one surface of the extension (6) towards the tube (1); a mortise (8) matched with the tenon (7) is formed in the surface of the tube (1); and the tenon (7) is closely matched with the mortise (8).

4. The spool according to claim 3, wherein skid-proof stripes (9) are disposed at an outer side of the resilient clip (5).

5. The spool according to claim 4, wherein the skid-proof stripes (9) are also disposed on the step portion (2).

6. The spool according to claim 5, wherein the cutting groove (3) has a width of 1-1.5 mm and a depth of 2 mm.

7. The spool according to claim 6, wherein the resilient clip (5) has a thickness of 0.3-0.6 mm.

8. The spool according to claim 7, wherein the extension (6) has a thickness of 0.8-1.2 mm.

* * * * *